US006823680B2

(12) United States Patent
Jayanth

(10) Patent No.: US 6,823,680 B2
(45) Date of Patent: Nov. 30, 2004

(54) REMOTE DATA ACQUISITION SYSTEM AND METHOD

(75) Inventor: Nagaraj Jayanth, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 9 days.

(21) Appl. No.: 10/280,774

(22) Filed: Oct. 25, 2002

(65) Prior Publication Data

US 2003/0051490 A1 Mar. 20, 2003

Related U.S. Application Data

(63) Continuation of application No. 10/012,631, filed on Dec. 7, 2001, now Pat. No. 6,560,976, which is a continuation of application No. 09/721,594, filed on Nov. 22, 2000, now Pat. No. 6,324,854.

(51) Int. Cl.[7] ..... F25B 49/02

(52) U.S. Cl. ..... 62/127; 62/230; 236/51; 700/276

(58) Field of Search ..... 62/125, 126, 127, 62/129, 130, 230; 165/11.1, 11.2; 236/51, 94; 700/276, 277, 278

(56) References Cited

U.S. PATENT DOCUMENTS

| | | | | |
|---|---|---|---|---|
| 3,232,519 A | | 2/1966 | Long | |
| 4,470,092 A | | 9/1984 | Lombardi | |
| 4,497,031 A | | 1/1985 | Froehling et al. | |
| 4,520,674 A | | 6/1985 | Canada et al. | |
| 4,630,670 A | | 12/1986 | Wellman et al. | |
| 4,755,957 A | | 7/1988 | White et al. | |
| 4,798,055 A | | 1/1989 | Murray et al. | |
| 4,831,560 A | | 5/1989 | Zaleski | |
| 4,881,184 A | | 11/1989 | Abegg, III et al. | |
| 4,885,707 A | | 12/1989 | Nichol et al. | |
| 4,885,914 A | * | 12/1989 | Pearman | 62/129 |
| 4,964,060 A | | 10/1990 | Hartsog | |
| 4,985,857 A | | 1/1991 | Bajpai et al. | |
| 5,058,388 A | | 10/1991 | Shaw et al. | |
| 5,071,065 A | | 12/1991 | Aalto et al. | |
| 5,073,862 A | | 12/1991 | Carlson | |
| 5,115,406 A | | 5/1992 | Zatezalo et al. | |
| 5,279,458 A | * | 1/1994 | DeWolf et al. | 236/47 |
| 5,299,504 A | | 4/1994 | Abele | |
| 5,311,451 A | | 5/1994 | Barrett | |
| 5,335,507 A | | 8/1994 | Powell | |
| 5,416,781 A | | 5/1995 | Ruiz | |
| 5,440,890 A | | 8/1995 | Bahel et al. | |
| 5,440,895 A | | 8/1995 | Bahel et al. | |
| 5,446,677 A | | 8/1995 | Jensen et al. | |
| 5,454,229 A | | 10/1995 | Hanson et al. | |
| 5,460,006 A | * | 10/1995 | Torimitsu | 62/127 |
| 5,481,481 A | | 1/1996 | Frey et al. | |
| 5,499,512 A | * | 3/1996 | Jurewicz et al. | 62/229 |
| 5,511,387 A | | 4/1996 | Tinsler | |
| 5,528,908 A | | 6/1996 | Bahel et al. | |
| 5,548,966 A | | 8/1996 | Tinsler | |
| 5,596,507 A | * | 1/1997 | Jones et al. | 700/276 |
| 5,630,325 A | | 5/1997 | Bahel et al. | |
| 5,875,638 A | | 3/1999 | Tinsler | |
| 5,956,658 A | | 9/1999 | McMahon | |
| 6,081,750 A | | 6/2000 | Hoffberg et al. | |
| 6,179,214 B1 | * | 1/2001 | Key et al. | 236/51 |
| 6,279,332 B1 | * | 8/2001 | Yeo et al. | 62/125 |
| 6,502,409 B1 | * | 1/2003 | Gatling et al. | 62/80 |
| 2001/0025349 A1 | | 9/2001 | Sharwood et al. | |

FOREIGN PATENT DOCUMENTS

| | | |
|---|---|---|
| EP | 0 453 302 A1 | 10/1991 |
| EP | 0 877 462 A2 | 11/1998 |
| GB | 2 062 919 A | 5/1981 |

* cited by examiner

*Primary Examiner*—Harry B. Tanner
(74) *Attorney, Agent, or Firm*—Harness, Dickey & Pierce, P.L.C.

(57) ABSTRACT

A data acquisition system and method includes monitoring a cooling system having a refrigerant compressor, evaporator, and condensor, and employs a number of sensors to monitor various operating parameters of the system. A database stores predefined operating parameters for a plurality of cooling systems. The operating parameters are provided to a computer, which compares the provided operating parameters of the monitored cooling system with the predefined operating parameters to provide diagnostic results for the monitored cooling system.

45 Claims, 2 Drawing Sheets

REMOTE DATA ACQUISITION SYSTEM AND METHOD

CROSS-REFERENCE TO RELATED APPLICATIONS

This application is a continuation of U.S. patent application Ser. No. 10/012,631 filed on Dec. 7, 2001, now U.S. Pat. No. 6,560,976, which is a continuation of U.S. patent application Ser. No. 09/721,594 filed on Nov. 22, 2000, now U.S. Pat. No. 6,324,854, which are incorporated herein by reference.

FIELD OF THE INVENTION

The present invention relates generally to an apparatus and a method for servicing an air-conditioning system. More particularly, the present invention relates to an apparatus and a method for servicing an air-conditioning system which utilizes a data acquisition system for communicating with the air-conditioning system and a hand held computer which analyzes the information received from the data acquisition system.

BACKGROUND AND SUMMARY OF THE INVENTION

Several air-conditioning service units are available to assist a trained technician in servicing an air-conditioning system. Some prior art units are adapted to be connected to the high- and low-pressure sides of the air-conditioning system and these units include gauges for measuring the high and low side pressures of the system under the appropriate operating conditions. These measured values are then manually compared with known standards for the particular air-conditioning system being tested. From this manual comparison and other observable characteristics of the system, the technician decides whether or not the system is operating properly. If a system malfunction is indicated, the technician determines the possible causes of the malfunction and decides how the system should be repaired.

Expensive and high-end large commercial air-conditioning systems are typically provided with their own sophisticated electronics and a host of internal sensors. The sophisticated electronics and the host of sensors for these large commercial systems simplify the diagnosis for these systems. However, the costs associated with these electronics and the sensors is too much for cost sensitive systems like residential air-conditioning systems and small commercial installations. In these smaller systems, the servicing efficiency is still dependent upon the skill of the technician. The tools that the technician typically uses to help in the diagnosis are pressure gauges, service units which suggest possible fixes, common electronic instruments like multimeters and component data books which supplement the various service units that are available. Even though these tools have improved over the years in terms of accuracy, ease of use and reliability, the technician still has to rely on his own personal skill and knowledge in interpreting the results of these instruments. The problems associated with depending upon the skill and knowledge of the service technician is expected to compound in the future due in part to the introduction of many new refrigerants. Thus, the large experience that the technicians have gained on current day refrigerants will not be adequate for the air-conditioning systems of the future. This leads to a high cost for training and a higher incident of misdiagnosing which needs to be addressed.

During the process of this diagnosis by the technician, he typically relies on his knowledge and his past experience.

Thus, accurate diagnosis and repair require that the technician possess substantial experience. The problem of accurate diagnosis is complicated by the large number of different air-conditioning systems in the marketplace. While each air-conditioning system includes a basic air-conditioning cycle, the various systems can include components and options that complicate the diagnosis for the system as a whole. Accordingly, with these prior art service units, misdiagnosis can occur, resulting in improperly repaired systems and in excessive time to complete repairs.

Although service manuals are available to assist the technician in diagnosing and repairing the air-conditioning systems, their use is time-consuming and inefficient. In addition, the large number of manuals require valuable space and each manual must be kept up to date.

In order to improve over the above described diagnosis procedures, service units have been designed which employ electronic processing means for initially diagnosing the air-conditioning system and, thereafter, if tests or repairs are needed, for guiding the mechanic to correction of its defective operation. When using these prior art service units, the technician identifies what type of system is being diagnosed. The service units are then capable of receiving signals which are indicative of the high and low side pressures of the air-conditioning system. Based upon the observed pressures in relation to the programmed standards for the type of air-conditioning system being tested, the service unit indicates whether or not the system is functioning properly. If the air-conditioning system is not functioning properly, a list of possible defective components and/or other possible causes of the system malfunction are identified. This list could range from a complete self-diagnosis where the problem is clearly identified to interactive dialog that narrows down the possible causes of the problem. The systems that monitor only the high and low pressure side pressures of the air-conditioning system are thus inherently limited in their diagnostic ability. What is needed is an air-conditioning service system which monitors not only the system's pressures, but the system should monitor other conditions such as various temperatures within the system as well as operating parameters of the motor driving the system in order to enable a more accurate diagnosis.

The present invention provides the art with a diagnostic system which is applicable to the present day air-conditioning systems as well as being adaptable to the air-conditioning systems of the future. The present invention provides a data acquisition system which includes a judicious integration of sensors. The sensors monitor the system's pressures, various temperatures within the system as well as operating parameters for the motor driving the system. By incorporating these additional sensors and specifically the motor operating sensors, the data acquisition system can provide better diagnostic results for the air-conditioning system. The data acquisition system coupled with a hand held computer using sophisticated software provides a reasonable cost diagnostic tool for a service technician. In the very cost sensitive systems like residential air-conditioning systems, this diagnostic tool eliminates the need for having each system equipped with independent sensors and electronics, yet they will still have the capability to assist the technician to efficiently service the air-conditioning system when there is a problem. The diagnostic tool also includes a wireless Internet link with a master computer which contains the service information on all of the various systems in use. In this way, the hand held computer can be constantly updated with new information as well as not being required to maintain files on every system.

If the technician encounters a system not on file in his hand held computer, a wireless Internet link to the master computer can identify the missing information.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
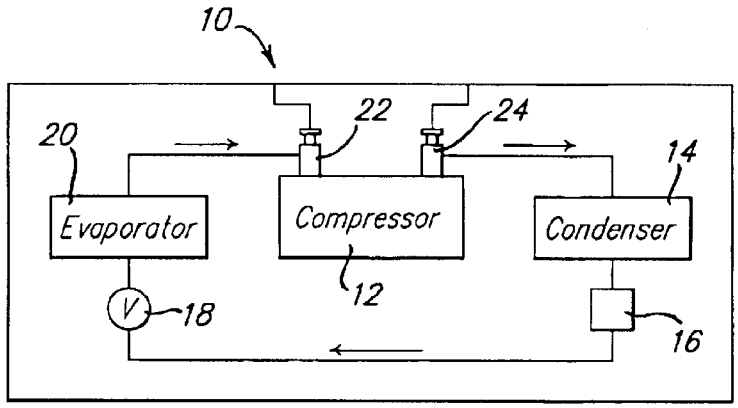
FIG. 1 schematically illustrates a typical air-conditioning system in accordance with the present invention.

Referring now to the drawings in which like reference numerals designate like or corresponding parts throughout the several views, there is shown in FIG. 1 an air-conditioning system for use with the service system in accordance with the present invention and which is designated generally by the reference numeral 10. Air-conditioning system 10 comprises a compressor 12 which compresses refrigerant gas and delivers it to a condensor 14 where the compressed gas is converted to a liquid. Condensor 14 discharges through a sight glass 16 which provides visual observation of the fill level of refrigerant in the system during operation. Sight glass 16 also normally includes a reservoir for storing liquid refrigerant under conditions of large load fluctuations on the system, and includes a high-pressure filter and desiccant to trap and hold any moisture or solid particles which may be present in the system. From sight glass 16, the refrigerant is delivered through an expansion valve 18 to an evaporator 20 where the refrigerant is evaporated into gaseous form as the system provides cooling in a well known manner. From evaporator 20, the refrigerant returns to compressor 12 to again start the above described refrigeration cycle.

For purposes of initial charging system 10 and for periodic servicing of system 10, compressor 12 has a pair of refrigerant ports 22 and 24. Port 22 is located at or near the low pressure suction port for compressor 12 and port 24 is located at or near the high pressure discharge port for compressor 12. Ports 22 and 24 provide connections for pressure gauge readings and for the addition of refrigerant and/or lubricating oil at either the suction side or the discharge side of compressor 12.

Figure 2:
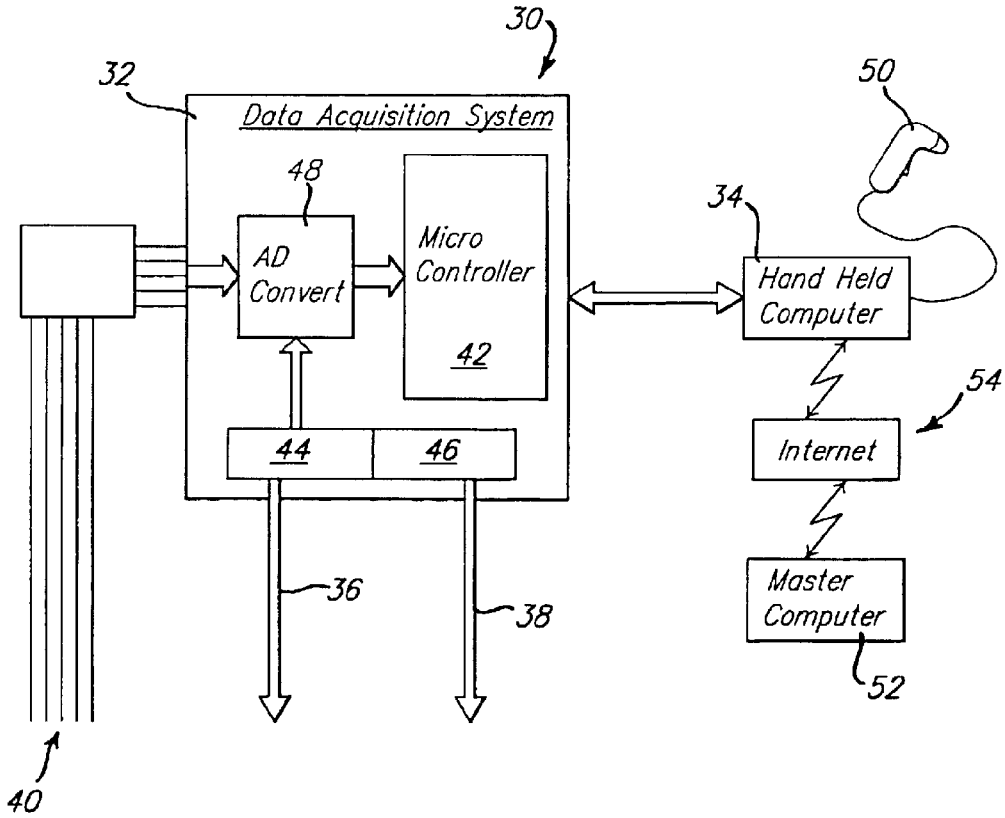
FIG. 2 schematically illustrates an air-conditioning service system in accordance with the present invention.
Figure 3:
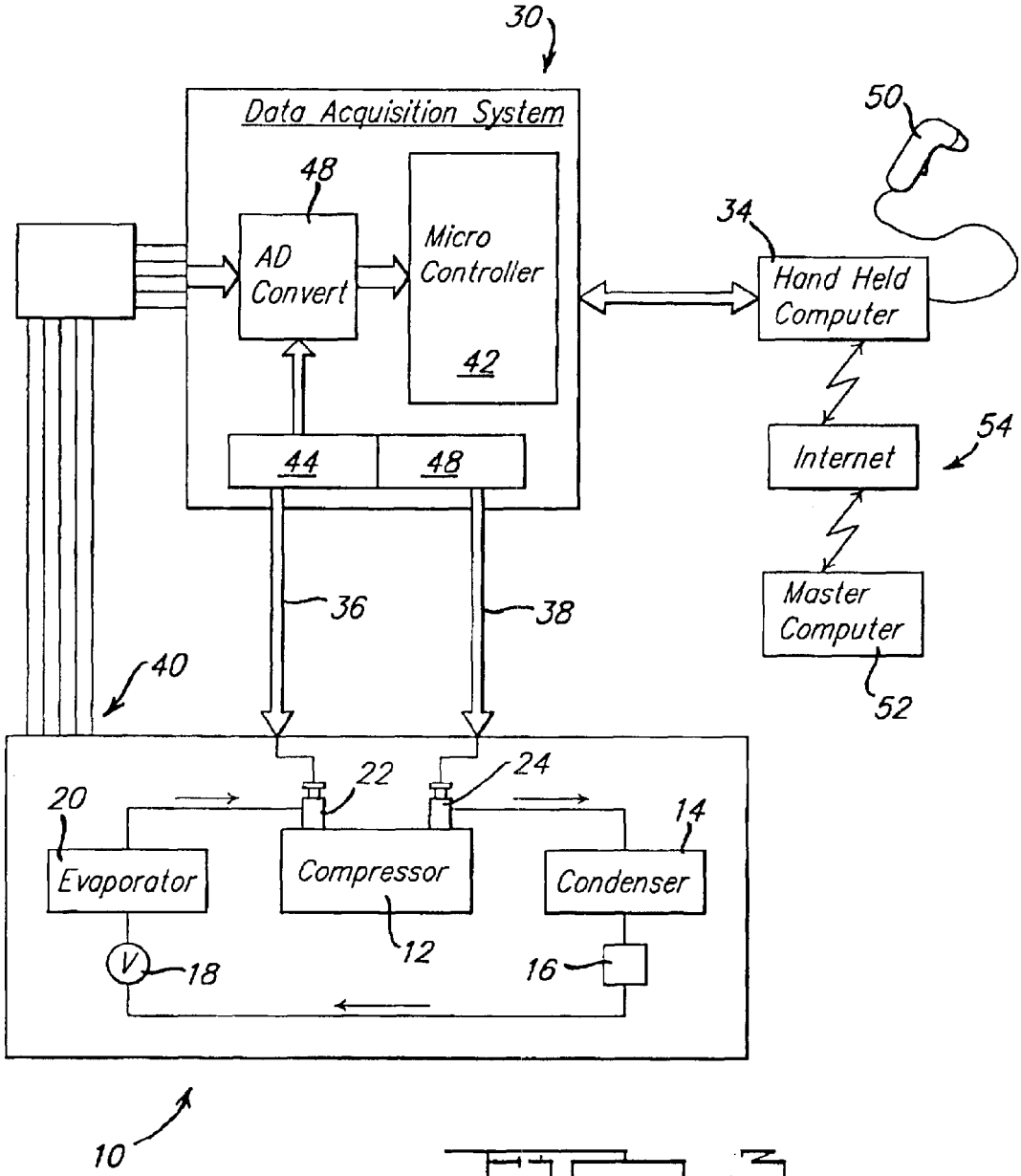
FIG. 3 schematically illustrates the air-conditioning service system shown in FIG. 2 coupled with the air-conditioning system shown in FIG. 1.

Referring now to FIGS. 2 and 3, an air-conditioning service system or apparatus 30 is illustrated. Apparatus 30 comprises a data acquisition system 32, a hand held computer 34, a pair of pressure hoses 36 and 38, and a plurality of sensors 40. Data acquisition system 32 includes a micro-controller 42, a pair of pressure sensors 44 and 46 and an Analog to Digital converter 48. Pressure hose 36 is adapted to be attached to port 22 to monitor the pressure at or near the suction port of compressor 12. Pressure hose 38 is adapted to be attached to port 24 to monitor the pressure at or near the discharge port of compressor 12. Each hose 36 and 38 is in communication with sensors 44 and 46, respectively, and each sensor 44 and 46 provides an analog signal to A/D converter 48 which is indicative of the pressure being monitored. A/D converter 48 receives the analog signal from sensors 44 and 46, converts this analog signal to a digital signal which is indicative of the pressure being monitored and provides this digital system to micro-controller 42.

Sensors 40 are adapted to monitor various operating characteristics of compressor 12. Several sensors 40 monitor specific temperatures in the system, one sensor monitors compressor supply voltage, one sensor monitors compressor supply amperage and one sensor monitors the rotational speed (RPM) for compressor 12. Typical temperatures that can be monitored include evaporator refrigerant temperature, condenser refrigerant temperature, ambient temperature and conditioned space temperature. The analysis of parameters like compressor voltage, compressor current, compressor RPM and discharge temperature can provide valuable information regarding the cause of the problem. Each sensor 40 is connected to A/D converter 48 and sends an analog signal indicative of its sensed parameter to A/D converter 48. A/D converter 48 receives the analog signals from sensors 40 and converts them to a digital signal indicative of the sensed parameter and provides this digital signal to micro-controller 42.

Micro-controller 42 is in communication with computer 34 and provides to computer 34 the information provided by micro-controller 42. Once computer 34 is provided with the air-conditioning system configuration and the sensed parameters from sensors 40, 44 and 46, a diagnostic program can be performed. The air-conditioning system configuration can be provided to computer 34 manually by the technician or it can be provided to computer 34 by a bar code reader 50 if the air-conditioning system is provided with a bar code label which sufficiently identifies the air-conditioning system.

In order for the diagnostic program to run, computer 34 must know what the normal parameters for the monitored air conditioning system should be. This information can be kept in the memory of computer 34, it can be kept in the larger memory of a master computer 52 or it can be kept in both places. Master computer 52 can be continuously updated with new models and revised information as it becomes available. When accessing the normal parameters in its own memory, computer 34 can immediately use the saved normal parameters or computer 34 can request the technician to connect to master computer 52 to confirm and/or update the normal parameters. The connection to the master computer 52 is preferably accomplished through a wireless Internet connection 54 in order to simplify the procedure for the technician. Also, if the particular air conditioning system being monitored is not in the memory of computer 34, computer 34 can prompt the technician to connect to master computer 52 using wireless Internet connection 54 to access the larger data base which is available in the memory of master computer 52. In this way, computer 34 can include only the most popular systems in its memory but still have access to the entire population or air-conditioning systems through connection 54. While the present invention is being illustrated utilizing wireless Internet connection 54, it is within the scope of the present invention to communicate between computers 34 and 52 using a direct wireless or a wire connection if desired.

The technician using apparatus 30 would first hook up pressure hose 36 to port 22 and pressure hose 38 to port 24. The technician would then hook up the various temperature sensors 40, the compressor supply voltage and current sensors 40 and the compressor RPM sensor 40. The technician would then initialize computer 34 and launch the diagnostics application software. The software on start-up prompts the technician to set up the test session. The technician then picks various options such as refrigerant type of the system and the system configuration, like compressors and system model number, expansion device type or other information for the configuration system. Optionally this information can be input into computer 34 using a barcode label and barcode reader 50 if this option is available. The software then checks to see if the operating information for the system or the compressor model exists within its memory. If this information is not within its memory, computer 34 will establish a wireless connection to master computer 52 through wireless Internet connection 54 and access this information from master computer 52. Also, optionally, computer 34 can prompt the technician to update the existing information in its memory with the information contained in the memory of master computer 52 or computer 34 can prompt the technician to add the missing information to its memory from the memory of master computer 52.

Once the test session is set up, the software commands micro-controller 42 to acquire the sensed values from sensors 40,44 and 46. Micro-controller 42 has its own custom software that verifies the integrity of the values reported by sensors 40, 44 and 46. An example would be that micro-controller 42 has the ability to detect a failed sensor. The sensors values acquired by micro-controller 42 through A/D converter 48 are reported back to computer 34. This cycle of sensor data is acquired continuously throughout the test session. The reported sensed data is then used to calculate a variety of system operating parameters. For example, superheat, supercooling, condensing temperature, evaporating temperature, and other operating parameters can be determined. The software within computer 34 then compares these values individually or in combination with the diagnostics rules programmed and then based upon these comparisons, the software derives a set of possible causes to the differences between the measured values and the standard operating values. The diagnostic rules can range from simple limits to fuzzy logic to trend analysis. The diagnostic rules can also range from individual values to a combination of values.

For example, the current drawn by compressor 12 is related to the suction and discharge pressures and is unique to each compressor model. Also, the superheat settings are unique to each air-conditioning system. Further, the diagnostic rules are different for different system configurations like refrigerant type, expansion device type, compressor type, unloading scheme, condenser cooling scheme and the like. In some situations, the application of the diagnostic rules may lead to the requirement of one or more additional parameters. For example, the diagnostic system may require the indoor temperature which may not be currently sensed. In this case, the technician will be prompted to acquire this valve by other means and to input its value into the program. When the criteria for a diagnostic rule have been satisfied, then a cause or causes of the problem is displayed to the technician together with solutions to eliminate the problem. For example, a high superheat condition in combination with several other conditions suggests a low refrigerant charge and the solution would be to add refrigerant to the system. The technician can then carry out the suggested repairs and then rerun the test. When the system is again functioning normally, the test results and the sensed values can be saved for future reference.

While sensors 40 are disclosed as being hard wired to A/D converter 48, it is within the scope of the present invention to utilize wireless devices to reduce the number of wiring hookups that need to be made.

Also, while apparatus 30 is being disclosed as a diagnostic tool, it is within the scope of the present invention to include an automatic refrigerant charging capability through hoses 36 and 38 if desired. This would involve the addition of a control loop to meter refrigerant into the system from a charging cylinder. Accurate charging would be accomplished by continuously monitoring the system parameters during the charging process.

While the above detailed description describes the preferred embodiment of the present invention, it should be understood that the present invention is susceptible to modification, variation and alteration without deviating from the scope and fair meaning of the subjoined claims.

What is claimed is:

1. A data acquisition system for monitoring a cooling system including a microcontroller, a refrigerant compressor, evaporator, and condenser, said data acquisition system comprising:

a database including predefined operating parameters for a plurality of cooling systems, said predefined operating parameters including compressor type and refrigerant type;

a computer having an input for receiving a monitored operating parameter, in communication with the microcontroller to receive said monitored operating parameter and in communication with said database to compare said monitored operating parameter with said predefined operating parameters of one of the plurality of cooling systems; and a first sensor in communication with the microcontroller and adapted to sense a superheat value of the cooling system;

wherein said monitored operating parameter includes at least said superheat, said computer being operable to diagnose the cooling system based on comparing said monitored operating parameter to said predefined operating parameters.

2. The data acquisition system in accordance with claim 1, further comprising a second sensor in communication with the microcontroller and adapted to sense a second operating parameter of the cooling system.

3. The data acquisition system in accordance with claim 2, further comprising a third sensor in communication with the microcontroller and adapted to sense a motor operating parameter of the cooling system.

4. The data acquisition system in accordance with claim 3, wherein said monitored operating parameter includes said motor operating parameter and at least one of said first operating parameter and said second operating parameter.

5. The data acquisition system in accordance with claim 4, wherein said second operating parameter includes a low side pressure of the cooling system and a high side pressure of the cooling system, and said motor operating parameter is a supply voltage to the compressor of the cooling system.

6. The data acquisition system in accordance with claim 5, wherein said second operating parameter includes a low side pressure of the cooling system and a high side pressure of the cooling system, and said motor operating parameter is a supply amperage to the compressor of the cooling system.

7. The data acquisition system in accordance with claim 4, wherein said second operating parameter includes a low side pressure of the cooling system and a high side pressure of the cooling system, and said motor operating parameter is a rotational speed of the compressor of the cooling system.

8. The data acquisition system in accordance with claim 3, wherein said monitored operating parameter includes said superheat value, said second operating parameter, and said motor operating parameter.

9. The data acquisition system in accordance with claim 8, wherein said second operating parameter includes a supply amperage to the compressor and a supply voltage to the compressor, and the motor operating parameter is a rotational speed of the compressor.

10. The data acquisition system in accordance with claim 1, further comprising:

a master computer disposed remote from said computer; and a wireless connection between said computer and said master computer.

11. The data acquisition system in accordance with claim 10, wherein said wireless connection includes a connection to the Internet.

12. The data acquisition system in accordance with claim 1, wherein said computer outputs instructions for repairing the cooling system.

13. The data acquisition system in accordance with claim 1, wherein said computer is a hand held computer.

14. The data acquisition system in accordance with claim 1, wherein said predefined operating parameters are selected from a group including: expansion device type; unloading scheme; and condenser cooling scheme.

15. The data acquisition system in accordance with claim 1, wherein said monitored operating parameters are selected from a group including: super cooling; condensing temperature; evaporating temperature; motor current; suction pressure; and discharge pressure.

16. A data acquisition system for monitoring a cooling system including a microcontroller, a refrigerant compressor, evaporator, and condenser, said data acquisition system comprising:

a database including predefined operating parameters for a plurality of cooling systems, said predefined operating parameters including compressor type and refrigerant type;

a computer having access to said database and input for receiving a monitored operating parameter, said computer in communication with the microcontroller to receive said monitored operating parameter;

a first sensor in communication with the microcontroller and adapted to sense a superheat value of the cooling system; and wherein said monitored operating parameter includes at least said superheat value, and said computer being operable to compare said monitored operating parameter to said predefined operating parameters to diagnose the cooling system.

17. The data acquisition system in accordance with claim 16, further comprising a second sensor in communication with the microcontroller and adapted to sense a second operating parameter of the cooling system.

18. The data acquisition system in accordance with claim 17, further comprising a third sensor in communication with the microcontroller and adapted to sense a motor operating parameter of the cooling system.

19. The data acquisition system in accordance with claim 18, wherein said monitored operating parameter includes said motor operating parameter and at least one of said first operating parameter and said second operating parameter.

20. The data acquisition system in accordance with claim 16, wherein said memory of said computer includes a data base of predefined operating parameters for a plurality of cooling systems, said computer being operable to compare said monitored operating parameter with said predefined operating parameters of one of the plurality of cooling systems to diagnose the cooling system.

21. The data acquisition system in accordance with claim 19, wherein said second operating parameter includes a low side pressure of the cooling system and a high side pressure of the cooling system, and said motor operating parameter is a supply voltage to the compressor of the cooling system.

22. The data acquisition system in accordance with claim 19, wherein said second operating parameter includes a low side pressure of the cooling system and a high side pressure of the cooling system, and said motor operating parameter is a supply amperage to the compressor of the cooling system.

23. The data acquisition system in accordance with claim 19, wherein said second operating parameter includes a low side pressure of the cooling system and a high side pressure of the cooling system, and said motor operating parameter is a rotational speed of the compressor of the cooling system.

24. A data acquisition system for monitoring a cooling system including a microcontroller, or refrigerant compressor, evaporator, and condenser, said data acquisition system comprising:

a database including predefined operating parameters defined by compressor type, refrigerant type and expansion device type, said database disposed at a location remote from the microcontroller;

a computer having an input for receiving a monitored operating parameter and in communication with said database via the Internet to receive said predefined operating parameters;

a first sensor in communication with the microcontroller and adapted the sense of first operating parameter of the cooling system; and a diagnostic module operable by said computer to compare said monitored operating parameter to said predefined operating parameters and output a diagnosis for the cooling system.

25. The method for monitoring a system in accordance with claim 24 wherein said database includes said predefined operating parameters for a plurality of cooling systems, wherein said computer is in communication with said data base to compare said monitored operating parameter with said predefined operating parameters of one of the plurality of cooling systems.

26. The data acquisition system in accordance with claim 24 further comprising a second sensor in communication with the microcontroller and adapted to sense a second operating parameter of the cooling system.

27. The data acquisition system in accordance with claim 26, a further comprising third sensor in communication with the microcontroller and adapted to sense a motor operating parameter of the cooling system.

28. The data acquisition system in accordance with claim 27, wherein said monitored operating parameter includes said motor operating parameter and at least one of said first operating parameter and said second operating parameter.

29. The data acquisition system in accordance with claim 28, wherein said first operating parameter is a low side pressure of the cooling system, said second operating parameter is a high side pressure of the cooling system and said motor operating parameter is a supply voltage to the compressor of the cooling system.

30. The data acquisition system in accordance with claim 28, wherein said first operating parameter is a low side pressure of the cooling system, said second operating parameter is a high side pressure of the cooling system and said motor operating parameter is a supply amperage to the compressor of the cooling system.

31. The data acquisition system in accordance with claim 28, wherein said first operating parameter is a low side pressure of the cooling system, said second operating parameter is a high side pressure of the cooling system and said motor operating parameter is a rotational speed of the compressor of the cooling system.

32. The data acquisition system in accordance with claim 27, wherein said monitored operating parameter includes said first operating parameter, said second operating parameter, and said motor operating parameter.

33. The data acquisition system in accordance with claim 32, wherein said first operating parameter is a supply amperage to the compressor, said second operating parameter is a supply voltage to the compressor, and the motor operating parameter is a rotational speed of the compressor.

34. The data acquisition system in accordance with claim 32, wherein said first operating parameter is a low side pressure of the cooling system, said second operating parameter is a high side pressure of the cooling system and said motor operating parameter is a supply voltage to the compressor of the cooling system.

35. The data acquisition system in accordance with claim 32, wherein said first operating parameter is a low side pressure of the cooling system, said second operating parameter is a high side pressure of the cooling system and said motor operating parameter is a supply amperage to the compressor of the cooling system.

36. The data acquisition system in accordance with claim 32, wherein said first operating parameter is a low side pressure of the cooling system, said second operating parameter is a high side pressure of the cooling system and said motor operating parameter is a rotational speed of the compressor of the cooling system.

37. A method for monitoring a system including a refrigerant compressor, evaporator, and condenser, said method comprising:

measuring a superheat value of the monitored system;

measuring a motor current value of the monitored system;

selecting a set of predefined operating parameters for a model system based on compressor type and refrigerant type from a database including predefined operating parameters for a plurality of model systems;

comparing said set of predefined operating parameters with said measured superheat and motor current values of the monitored system; and outputting diagnostic results from said comparison.

38. The method for monitoring a system in accordance with claim 37, further comprising the step of measuring another motor operating parameter of the monitored system wherein said inputting step includes inputting said motor operating parameter to said computer.

39. The method for monitoring a system in accordance with claim 37, wherein said selecting step includes manually inputting an identifier of the monitored system.

40. The method for monitoring a system in accordance with claim 37, wherein said selecting step includes inputting an identifier of the monitored system with a barcode reader.

41. The method for monitoring a system in accordance with claim 37, wherein said selecting step includes communicating between said computer and a master computer using a wireless connection.

42. The method for monitoring a system in accordance with claim 37, wherein said communicating between said computer and said master computer includes communicating through the Internet.

43. The method for monitoring a system in accordance with claim 37, wherein said outputting diagnostic results includes providing instructions for repairing the monitored system.

44. The method for monitoring a system in accordance with claim 37, further comprising performing a test session prior to comparing said set of predefined operating parameters with said superheat and motor current values of the monitored system.

45. The method for monitoring a system in accordance with claim 37, further comprising updating said data base from a master computer.

* * * * *

UNITED STATES PATENT AND TRADEMARK OFFICE

CERTIFICATE OF CORRECTION

PATENT NO. : 6,823,680 B2
DATED : November 30, 2004
INVENTOR(S) : Nagaraj Jayanth It is certified that error appears in the above-identified patent and that said Letters Patent is hereby corrected as shown below:

Column 8,
Line 31, "the sense of" should be -- to sense a --.

Signed and Sealed this

Twenty-second Day of March, 2005

JON W. DUDAS
*Director of the United States Patent and Trademark Office*